United States Patent [19]

Steingroever et al.

[11] 4,381,492

[45] Apr. 26, 1983

[54] APPARATUS FOR MAGNETIZING MULTIPOLAR PERMANENT MAGNETS

[76] Inventors: Erich Steingroever, Flensburger Strasse 33, 53 Bonn; Dietrich Steingroever, Bergisch-Gladbach, both of Fed. Rep. of Germany

[21] Appl. No.: 293,922

[22] Filed: Aug. 18, 1981

[30] Foreign Application Priority Data

Aug. 25, 1980 [DE] Fed. Rep. of Germany ..... 3031983

[51] Int. Cl.[3] ..... H01F 13/00

[52] U.S. Cl. ..... 335/284; 361/143

[58] Field of Search ..... 335/284, 302; 361/143, 361/147

[56] References Cited

U.S. PATENT DOCUMENTS 3,158,797 11/1964 Andrews ..... 335/284

3,678,436 7/1972 Herdrich ..... 335/284

*Primary Examiner*—George Harris

*Attorney, Agent, or Firm*—Fisher, Christen & Sabol

[57] ABSTRACT

Apparatus for magnetizing permanent magnet bodies to provide them with narrow magnetic poles of alternating polarity consists of arranging an array of pairs of magnetizing conductors in such a manner that when each of the two conductors of each pair are connected in series each of the pairs of conductors can be connected in parallel directly to the two common magnetizing current supply leads.

12 Claims, 9 Drawing Figures

APPARATUS FOR MAGNETIZING MULTIPOLAR PERMANENT MAGNETS

BACKGROUND OF THE INVENTION

The invention concerns apparatus for magnetizing permanent magnets, which have a large number of poles arranged in a flat plane, or to define a curved surface, and particularly highly coercive permanent magnets of barium or strontium ferrite, alnico alloys or rare-earth-cobalt alloys.

Devices are known for this purpose which contain a single current conductor that is arranged in a meandering path, formed to correspond to the desired number of poles and pole arrangement and is to be energized by a heavy current for the purpose of magnetization.

The known design of these devices is elaborate and does not permit the construction of multipolar magnets having very narrow pole widths.

BRIEF SUMMARY OF THE INVENTION

The invention describes an arrangement of the current conductors that can be constructed easily and with high precision, even in the case where small poles having narrow pole pitches are to be formed in the magnet body.

The apparatus of the invention for magnetizing permanent magnets having a large number of poles defining a flat or curved surface comprises, in each pole gap, a single current conductor carrying a heavy-current pulse, and is characterized by the fact that pairs of the current conductors are connected in series, and the current-conductor pairs are also connected in parallel with each other by a third conductor at a point remote from the current supply connection.

This circuitry of the invention for the individual current conductors in the pole clearances permit the ends of the individual current conductors remote from the current feeds to be connected electrically with each other. This permits a simpler and mechanically more stable construction of the magnetizing devices, which is necessary in view of the high mechanical forces acting on the current conductors when heavy-current pulses are applied to them.

DETAILED DESCRIPTION OF THE INVENTION

Figure 1:
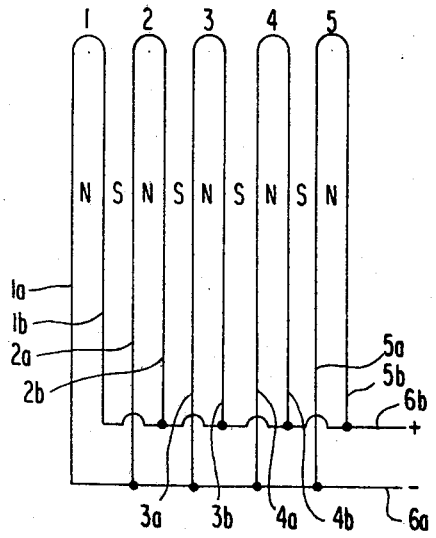
FIG. 1 is a schematic diagram of one arrangement for magnetizing multipolar magnet bodies by means of pairs of single conductors.

In the schematic diagram of FIG. 1, five pairs of series-connected current-carrying conductors 1, 2, 3, 4 and 5 are arranged in parallel. The conductors are arranged so that all of their free ends are disposed on one side of the array, while the junctions between the two conductors of each pair are disposed on the opposite side of the array. Thus, the free ends of conductors 1*a*, 2*a*, 3*a*, 4*a* and 5*a* are connected to a common lead 6*a* which is connected to a negative(−) side of a direct current power source (not shown) and the free ends of conductors 1*b*, 2*b*, 3*b*, 4*b* and 5*b* are connected to the positive(+) side of the power source by common lead 6*b*. During the current flow alternating magnetic poles, denoted by N and S, are formed between the individual conductors.

Figure 2:
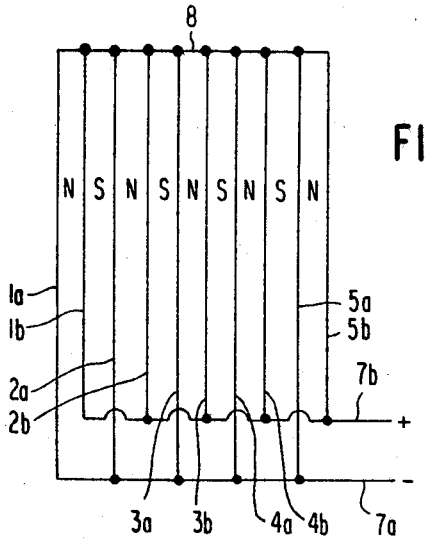
FIG. 2 is a schematic diagram of another embodiment of this invention.

The alternating magnetic fields created by these poles set up mechanical forces which must be counteracted in some way and, in accordance with this invention, it is proposed to connect the pairs of conductors together at locations which are remote from leads 6*a* and 6*b* and equipotential with respect to each other. As shown in FIG. 2 this is accomplished by connecting the ends of each of the conductors remote from their connections to the power source leads 7*a* and 7*b* to a common bridge member 8 which may also serve as a mechanical reinforcement.

Figure 3:
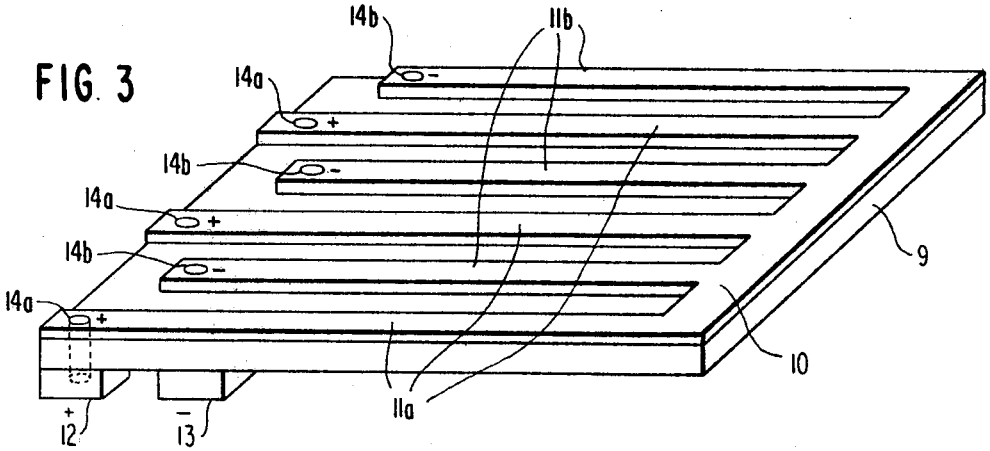
FIG. 3 is an embodiment of the invention for magnetizing a body having a flat surface to form a series of narrow poles of alternating polarity.

An embodiment of the arrangement shown in FIG. 2 is illustrated in FIG. 3, in which a flat substrate 9, of electrically non-conductive material supports an arrangement of parallel conductors 11*a* and 11*b* on one surface, all of the conductors being electrically connected together at one of the ends by a common bridge member 10.

The other ends of alternating parallel conductors 11*a* extend across the surface of substrate 9 for connection, as by means of conductive metal screws 14*a*, to a common supply lead 12 positioned on the opposite side of the substrate. The remaining conductors 11*b* are of slightly shorter length so that their respective other ends may be connected by conductive elements 14*b* to the other supply lead 13 on the opposite face of substrate 9.

Figure 4:
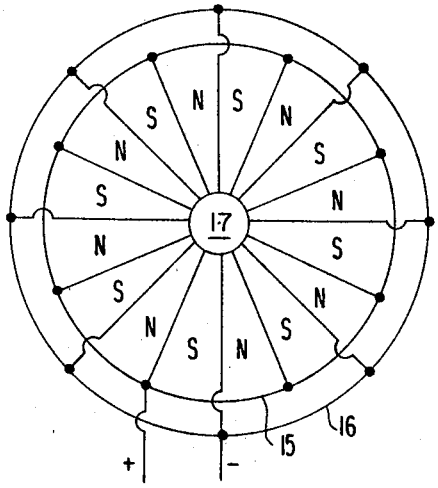
FIG. 4 is a schematic diagram of a modification for magnetizing a body with a series of arcuately arranged narrow sectors of alternating polarity.

Instead of a parallel arrangement it is also possible to place the conductors in other configurations so as to generate pie-shaped magnetic fields as shown by the star arrangement of FIG. 4. In this embodiment the conductors disposed in a radial array in which one end of each conductor is connected to a centrally disposed ring-shaped bridge member 17. Half of the conductors are connected at their other ends to a ring-shaped supply lead 15, while the alternate other half of the conductors are connected to another ring-shaped supply lead 16 to complete an energizing circuit from a power supply (not shown) to produce alternating pie-shaped poles N and S between the conductors.

Figure 5:
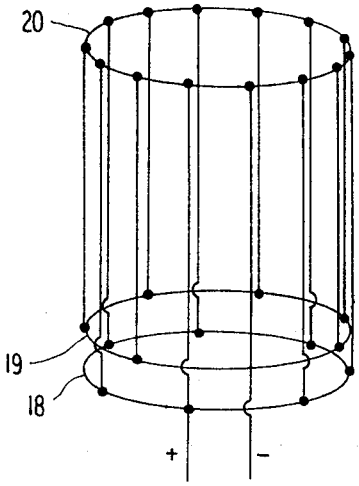
FIG. 5 is a schematic diagram of a plurality of pairs of conductors for magnetizing a cylindrical magnet body.
Figure 6A:
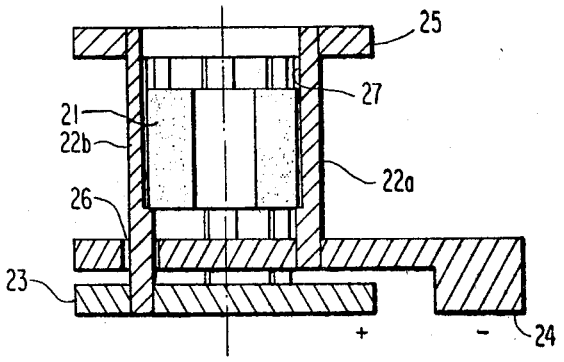
FIG. 6A is a cross-section on the line A-B of FIG. 6.
Figure 6:
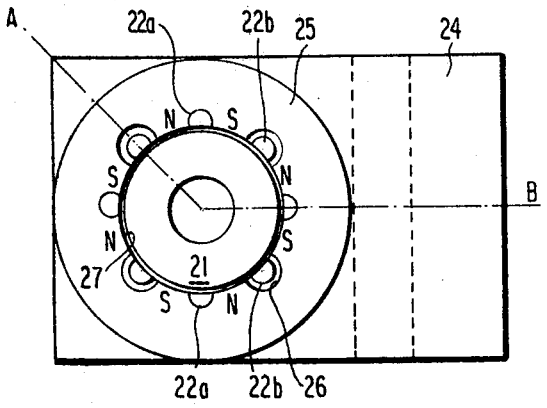
FIG. 6 is a plan view of apparatus embodying the circuit arrangement of FIG. 5.
Figure 7A:
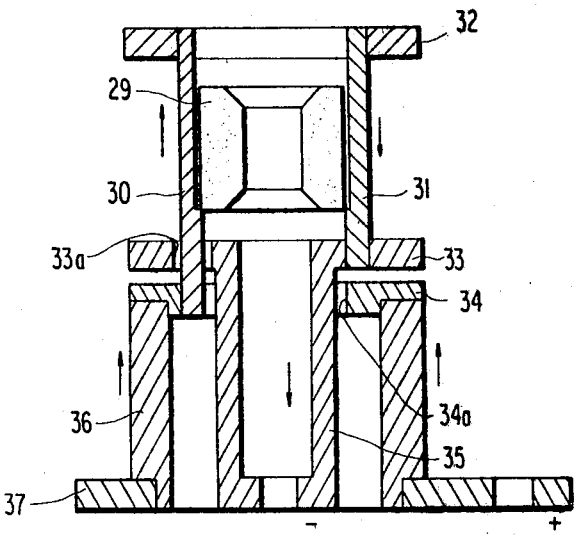
FIG. 7A is a cross-section on the line A-B of FIG. 7.
Figure 7:
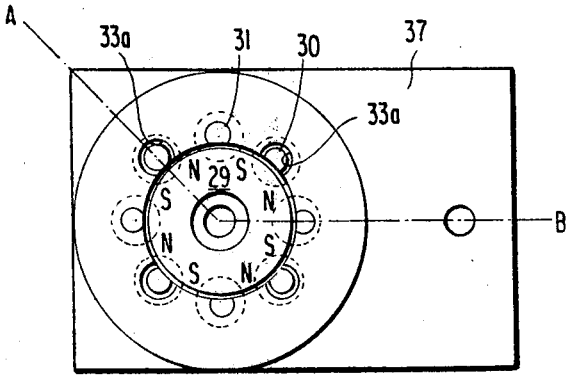
FIG. 7 is a plan view of a modification of the apparatus of FIG. 6.

The embodiment shown in FIGS. 5–7 are particularly advantageous for the multipolar magnetization of cylindrical elements, such as are used in generators or electrical motors. Such an arrangement is illustrated schematically in FIG. 5, where the conductors are connected alternately with the current feed rings 18 and 19 and on the distant end, they are connected with each other via the bridge 20.

A practical embodiment of a device, according to the invention, for multipolar magnetization of a cylindrical article is shown in FIGS. 6 and 6A, in which numeral 21 identifies a cylindrical element of permanent magnet material whose exterior surface is to be provided with eight poles of alternating polarity. In this arrangement a pair of flat electrically conductive plates 23 and 24 are arranged in superposed relationship and electrically isolated from each other to serve as the connections to a source of direct current (not shown) for the lower ends of the conductors 22*a* and 22*b*, which may comprise rods or bars, arranged in a cylindrical pattern parallel to each other, closely adjacent to the exterior periphery of element 21. Plate 24 also serves to support the lower ends of conductors 22*a* which alternate with conductors 22*b*, the lower ends of which extend downwardly through openings 26 in plate 24 to be supported by plate 23. The openings 26 should be large enough to electrically isolate conductors 22*b* from plate 24 or a sleeve of dielectric material may be used to provide additional stability to the structure. The upper ends of all the conductors 22*a* and 22*b* are electrically connected to each other by an electrically conductive ring-shaped bridge member 25, which is preferably mounted on the exterior sides of the conductors to minimize the effect of stray magnetic field on the article 21.

The current conductors should be arranged as close as possible to the permanent magnet to be magnetized so as to generate the greatest possible magnetization field strength. Therefore, in accordance with the invention, the conductors can be situated on a diameter so small that their inner surfaces can be machined together to collectively define portions of a cylindrical surface having a diameter the same as that of the peripheral surface of the article to be magnetized, as indicated by numeral 27 in FIGS. 6 and 6A.

To produce poles running diagonally across the axis of a cylindrical permanent magnet, the rod-shaped current conductors 22*a* and 22*b* are arranged in a correspondingly diagonal manner and are machined on their sides facing the magnet to the diameter of the permanent magnet.

A further embodiment of the invention is shown in FIGS. 7 and 7A, the purpose of which is to avoid the production of assymetrical radial or diametrical magnetic fields which may be produced between the conductors 22*a* and 22*b* of the modification of FIGS. 6 and 6A. Assymetrical fields of this type may occur, especially when employing high magnetization currents, when the plate-shaped current supplying lead 24 of FIGS. 6 and 6A is in such close proximity to the article to be magnetized that a diametrical field component passes through a portion of the article being magnetized.

In the device shown in FIGS. 7 and 7A the power supply leads terminate in a pair of tubular portions arranged concentrically with the axis of the tubular conductor array so that the assymetric portions of the supply leads are spaced so far from the body to be magnetized that any assymetric field passing through the body will be negligible.

In this modification, the cylindrical body to be magnetized with eight axially extending peripheral alternating magnetic poles is identified by numeral 29. As in the case of the previous modifications the body, or article, to be magnetized comprises a permanent magnetic material, such as a hard ferrite, alnico, a rare-earth-cobalt alloy or a similar material.

The conductors 30 and 31 are circularly arranged at alternating spaced intervals closely about the body 29, in an array similar to that of the conductors 22*b* and 22*a* of FIGS. 6 and 6A. The upper ends of conductors 30 and 31 are electrically connected to, and mechanically reinforced by, an exteriorly disposed electrically conductive ring-shaped member 32, while the lower ends of conductors are electrically connected to, and supported by, a ring-shaped electrically conductive flange 33 attached to the upper end of a tubular conductive lead 35 placed concentrically with respect to the conductor 30 and 31 and intended to be connected to one side of the direct current supply (not shown) for magnetizing the body 29.

The lower ends of the alternately arranged conductors 30 extend downwardly through suitably enlarged openings 33*a* provided in the flange 30 so as to electrically isolate conductors 30 from flange 33, and are electrically connected to, and mechanically supported by, another ring-shaped electrically conductive flange 34 spaced below flange 33. Flange 34 is provided with a central opening 34*a* which is large enough to electrically isolate the flange from the tubular member 35 and is electrically connected to, and mechanically supported by, the upper-end of a tubular conductive lead 36, which is preferably concentric with respect to number 35, and serves as a connection to the other side of magnetizing current supply. The lower end of the tubular member 36 may be attached to a base plate 37 which is provided with an opening to electrically isolate it from the tubular number 35 and to permit the lower end of number 35 and the plate 37 to serve, when placed upon an electrically non-conductive surface, as a stable support for the entire magnetizing assembly.

In operation, when the tubular leads 35 and 36 are connected respectively to the negative and positive sides of an electrical source, such as that provided by a capacitor discharge magnetizer, the directions of current flow in the conductors is shown by the arrows in FIG. 7A and the magnetic flux around each of the conductors 30 and 31 is shown by the broken lines in FIG. 7. The resulting poles produced in the periphery of the body 29 are indicated by the letters N and S in FIG. 7.

While the embodiments of the invention disclosed in FIGS. 3, 6 and 7 illustrate the use of rods, or bars, in the fabrication of the conductors such as would be used in magnetizing large motor or generator rotors, it is possible to use other techniques without departing from the spirit of this invention. For example, the conductors may comprise wires, or may be copper sheets, or foil, supported on non-conductive synthetic plastic and substrates and etched, or otherwise configured to the desired shapes as is well known in the manufacture of "printed" circuits.

The invention is suitable for the magnetization of a wide range of sizes of rotors for motors and generators. For use in 50 Hz. alternating current applications, synchronous motor rotors can be made as small as 30 mm. in diameter, provided with 8; 16 or 32 magnetic poles on their peripheral surfaces, while rotors having diameters at least as large as 100 mm., provided with 6; 8 or 10 poles, can be magnetized for use in motors or generators.

What is claimed is:

1. Apparatus for magnetizing a permanent magnet body to produce magnetic poles of successively alternating polarities on at least one surface of the body, comprising:

an array of pairs of elongated electrical conductors to be disposed in close proximity to said surface to be magnetized, the conductors of each pair being laterally spaced from each other and each of the pairs of conductors being laterally spaced from each other to define in the spaces between conductors of each pair a magnetic pole of one polarity and to define in the spaces between adjacent pairs of conductors a magnetic pole of the opposite polarity;

a pair of magnetizing direct current supply leads disposed in a predetermined path along a first portion of said array;

one end of each of the conductors in each of said pairs of conductors being connected to a respective one of said pair of current supply leads at said first portion of said array;

the other ends of each of the conductors in each pair of conductors being connected to each other at a location in said array remote from said first portion and having at said remote location the same electrical potential in each of said pairs of conductors, and;

a bridge conductor connected to all of said pairs of conductors at said remote locations.

2. Apparatus as defined in claim 1, wherein all of the conductors of said pairs of conductors are disposed in a common plane.

3. Apparatus as defined in claim 2, wherein the conductors of said pairs of conductors are disposed parallel with each other.

4. Apparatus as defined in claim 3, wherein the conductors of said pair of conductors comprise electrically conductive sheet metal or foil bonded to a dielectric substrate.

5. Apparatus as defined in claim 2, wherein the conductors of said pairs of conductors are disposed angularly with respect to each other along lines which radiate from a central common point to produce pie-shaped magnetic poles.

6. Apparatus as defined in claim 5, wherein the conductors of said pairs of conductors comprise electrically conductive sheet metal or foil bonded to a dielectric substrate.

7. Apparatus as defined in claim 1, wherein the conductors of said pairs of conductors comprise:

a plurality of electrically conductive rods, or bars arranged so as to generally define a cylindrical surface of revolution and extending parallel with each other in the generally lengthwise direction of said cylinder;

all of said rods, or bars, being connected at one of their ends to a common electrically conductive bridge element;

the respective alternate other ends of said rods, or bars, being connected to a respective one of a pair of electrically conductive magnetizing current supply members;

8. Apparatus as defined in claim 7, wherein said current supply members comprise a pair of plates extending generally radially with respect to said cylinder and spaced from each other in the axial direction.

9. Apparatus as defined in claim 7, wherein said current supply members comprise a pair of tubular elements concentrically disposed with respect to said cylinder and electrically isolated from each other.

10. Apparatus as defined in any one of claims 7, 8 or 9, wherein the inwardly facing sides of said rods, or bars, are arcuately formed to closely conform to the cylindrical surface of a body to be magnetized.

11. Apparatus as defined in claim 10, wherein said rods, or bars, are inclined with respect to the axis of said cylindrical surface of revolution.

12. Apparatus as defined in claim 10, wherein said conductive bridge element comprises a ring-shaped plate.

* * * * *